United States Patent [19]

Javanelle

[11] Patent Number: 4,649,846

[45] Date of Patent: Mar. 17, 1987

[54] WINDSURFING BOARD PORTAGE DEVICE

[75] Inventor: Pierre H. Javanelle, Chelles, France

[73] Assignee: Cabinet Michel Rataboul, Paris, France

[21] Appl. No.: 740,915

[22] PCT Filed: Sep. 26, 1984

[86] PCT No.: PCT/FR84/00210

§ 371 Date: Jul. 29, 1985

§ 102(e) Date: Jul. 29, 1985

[87] PCT Pub. No.: WO85/01487

PCT Pub. Date: Apr. 11, 1985

[22] Filed: Jul. 29, 1985

[30] Foreign Application Priority Data

Sep. 27, 1983 [FR] France ..... 83 15332

[51] Int. Cl.[4] ..... A63C 15/05

[52] U.S. Cl. ..... 114/39; 224/181; 441/74

[58] Field of Search ..... 114/39.2, 347, 343; 224/101, 148, 181, 186–190, 201, 205, 210, 265, 266, 270–272; 441/74

[56] References Cited

U.S. PATENT DOCUMENTS

| | | | |
|---|---|---|---|
| 3,021,985 | 7/1962 | Sarver | 224/189 |
| 3,120,332 | 2/1964 | White | 224/189 |
| 3,229,872 | 1/1966 | Williams | 224/181 |
| 4,016,615 | 4/1977 | Main | 114/347 |
| 4,236,267 | 12/1980 | Lewis et al. | 114/347 |

FOREIGN PATENT DOCUMENTS

| | | | |
|---|---|---|---|
| 2703726 | 8/1978 | Fed. Rep. of Germany | 224/189 |
| 54862 | 2/1935 | Norway | 224/181 |

*Primary Examiner*—Galen L. Barefoot
*Assistant Examiner*—Stephen P. Avila
*Attorney, Agent, or Firm*—Holman & Stern

[57] ABSTRACT

A windsurfing board portage device comprises two members adapted to bear on the shoulders of a person. A supporting frame for the windsurfing board is connected to these shoulder members by a strong structure. This structure comprises two uprights, a neck cross-member connecting the uprights and a forehead cross-member retaining the device in position on the head and shoulders of the user.

3 Claims, 3 Drawing Figures

WINDSURFING BOARD PORTAGE DEVICE

BACKGROUND OF THE INVENTION

1. Field of the Invention

The invention concerns the portage of windsurfing boards over medium or long distances to the water on which they are used.

2. Description of the Prior Art

As is known, a windsurfing board and its accessories represent a load of approximately 25 kg which, when it is to be used, must be transported over at least the width of a beach, which can be considerable in the case of tidal oceans. The load is generally transported over short distances by hand, with the component parts (board and sail) separated. Over longer distances it is preferable to make only one journey, either by carrying two complete boards between two persons or, when the user is alone, by carrying the complete board on the shoulder or on the head, which is hardly practicable and potentially harmful to the cervical vertebrae.

To eliminate this all manner of adaptable trolleys and wheels have been produced, but these are not always very effective given the generally sandy and irregular nature of the terrain.

The objective of the invention is to avoid the preceding disadvantages by providing a portage device enabling a board complete with its accessories to be carried comfortably and safely.

The invention consists essentially in providing a support bearing symmetrically on both shoulders of the user and supporting the board level above his head without pressing on it.

SUMMARY OF THE INVENTION

The present invention consists in a windsurfing board portage device comprising two members adapted to bear on the shoulders on a person, a supporting frame for the windsurfing board, and a strong structure connecting said supporting frame to said shoulder members, said structure comprising two uprights, a neck crossmember connecting said uprights and a forehead crossmember retaining the device in position on the head and shoulders of the user.

Other objects and advantages will appear from the following description of an example of the invention, when considered in conjunction with the accompanying drawings, and the novel features will be particularly pointed out in the appended claims.

DESCRIPTION OF THE PREFERRED EMBODIMENT

Figure 1:
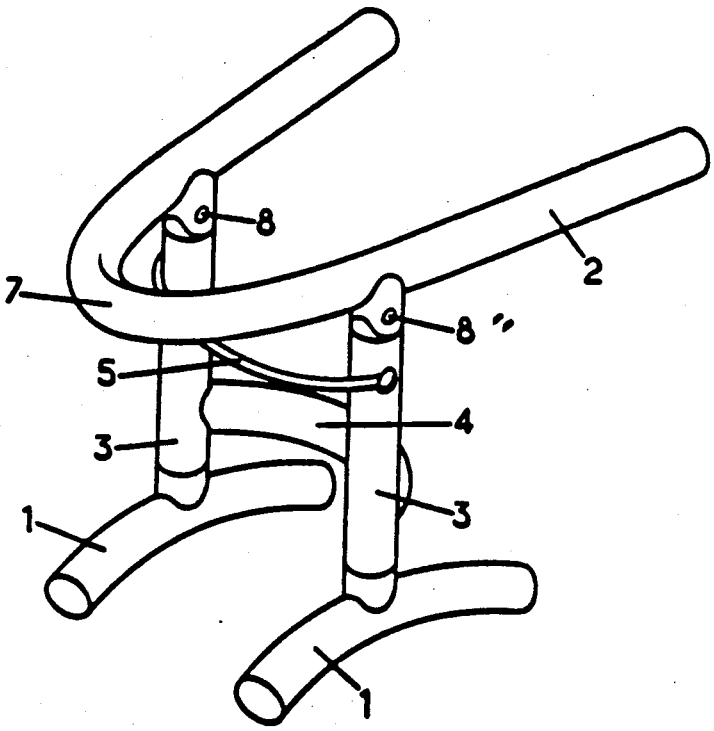
FIG. 1 is a perspective view of the device.

The device comprises at the bottom two shoulder members 1 of arcuate shape designed to fit over the shoulders of the user. In the upper part it comprises a substantially plane frame 2 having any suitable closed or open contour as seen from above and designed to support the board. Finally, between the frame 2 and the shoulder members 1 is disposed any suitable structure capable of transferring loads from one to the other.

in the example shown, this structure consists of two vertical uprights 3 of appropriate length, slightly greater than the distance between the top of the shoulders and the top of the head of a tall person. These two uprights 3 are connected by a neck crossmember 4, preferably of arcuate shape to extend around and fit snugly against, or below, the neck of the user.

Finally, the uprights 3 are also connected by a forehead crossmember 5 situated at the level of the forehead and preferably consisting of a simple strap, possibly adjustable.

The shoulder members 1 are naturally for preference padded, at least on their inside edge, as is the neck crossmember 4, and the support frame 2 is preferably provided with a non-skid facing, at least on its upper side in contact with the board.

Figure 2:
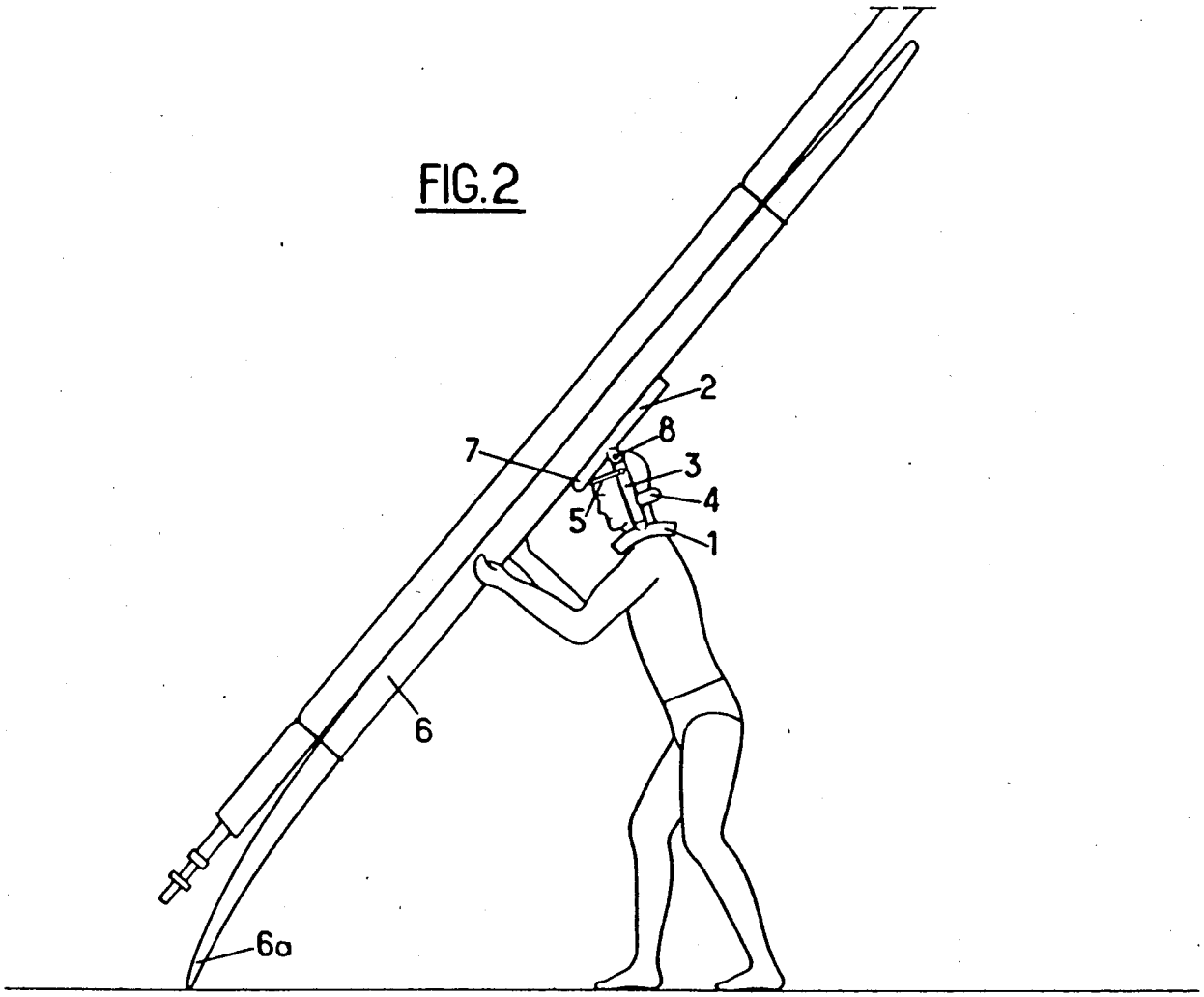
FIG. 2 shows the loading or unloading procedure.

To use the device, the board is first laid flat on the ground and its various accessories, in particular the mast and the wishbone, fixed on top of it by any known means. The user then places the device shown in FIG. 1 on his shoulders, slipping his head between the neck crossmember 4 and the forehead crossmember 5, as shown in FIG. 2, which enables him to manipulate the apparatus without having to hold it.

He can then lift the entire load 6 from the rear, leaving the pointed end 6a resting on the ground, and progressively walk under the board until the forward end 7 of the support frame 2 reaches the approximate position of the foot of the mast, that is to say slightly forward of the center of gravity of the assembly. The load may then be tilted about the bearing point 7 without effort until it rests flat on the frame 2, its center of gravity being substantially vertically above the center point between the uprights 3, in the position shown in FIG. 3, or slightly to the rear of it.

The user can then let go of the board, which remains perfectly balanced in a horizontal position, resting on his shoulder through the intermediary of the device, so that only very low forces need to be exerted on the crossmembers 4 and 5 and the muscles of the head are not fatigued, the head incidently not having to support any vertical load.

The user can then walk to his destination and proceed to off-load the board by carrying out the loading maneuvers in reverse.

Noting that the shoulders of a normal person are slightly arcuate towards the front, the comfort and the distribution of the load may be improved by placing the two shoulder members 1 not in parallel planes but in planes slightly convergent in the forward direction.

By way of further improvements each shoulder member 1 may be provided with a vertical tubular part disposed to rotate freely inside the corresponding upright 3, also formed by a tubular part, which enables the two members 1 to assume automatically the best possible orientation. This arrangement also enables the members 1 to be turned to lie flat in the plane of the uprights 3.

The portage frame 2 may also be pivoted to the upper ends of the uprights 3 by means of two pivots 8 with horizontal axes aligned with one another and offset below the frame to permit it to be folded into a plane parallel to and contiguous with the plane of the uprights 3, in order facilitate storage and transportation of the device.

Figure 3:
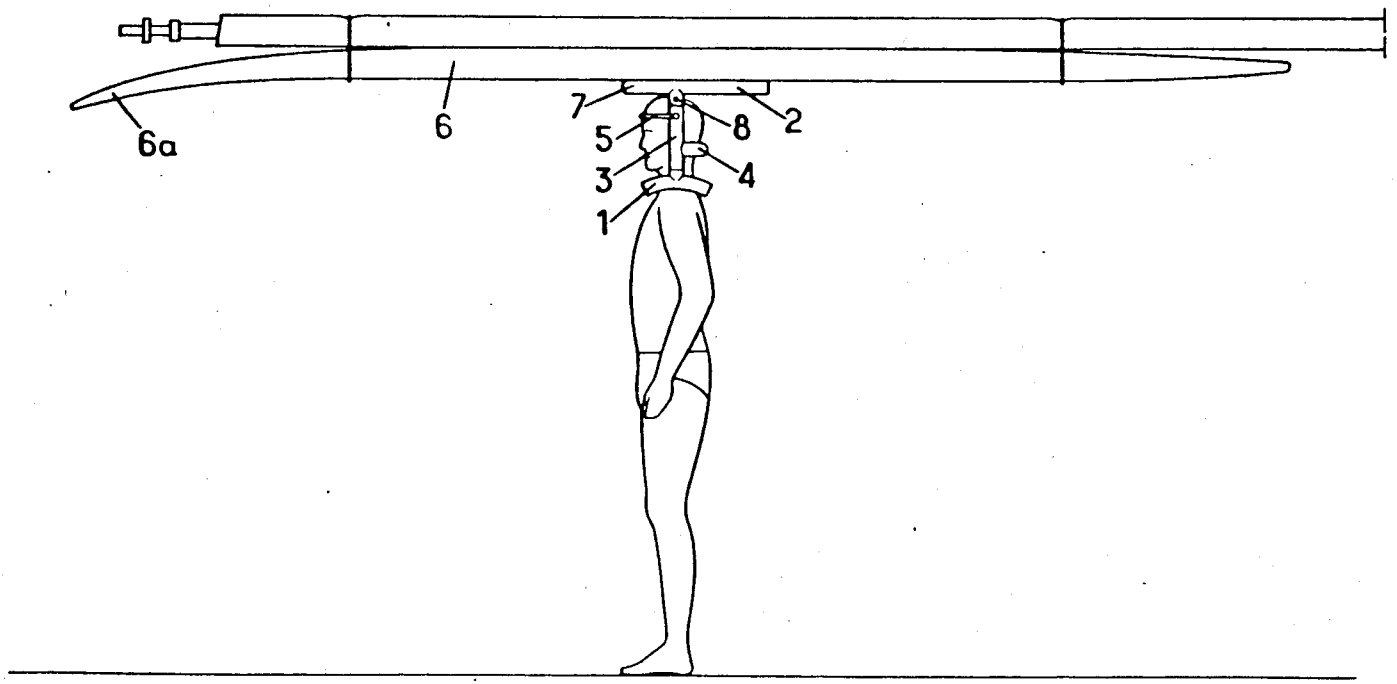
FIG. 3 shows the device in the portage position.

Furthermore, in this case, the ability of the frame 2 to tilt forwards makes it possible for the combination of the frame 6 and the load to tilt around the pivots 8, as shown in FIG. 2, instead of the load tilting around the end 7 as previously. On the other hand, the pivots 8 must then be provided with locking means (not shown)

to prevent the rear of the frame 2 tilting beyond the position at which it is perpendicular to the uprights 3, as shown in FIG. 3. Immobilization in this position during transportation is effected automatically by bringing the center of gravity of the load slightly to the rear of the vertical line through the uprights 3 and the pivots 8.

It will be understood that various changes in the details, materials and arrangements of parts which have been herein described and illustrated in order to explain the nature of the invention may be made by those skilled in the art within the principle and scope of the invention as expressed in the appended claims.

For example, the entire device may be readily dismantled and certain of its component parts, such as the uprights 3, for example, made to adjust in height telescopically and possibly provided with elastic damper means.

I claim:

1. Windsurfing board portage device comprising: two shoulder members adapted to bear on the shoulders of a person, a supporting frame for a windsurfing board, and a relatively strong structure connecting said supporting frame to said two shoulder members, said relatively strong structure comprising two uprights, a neck crossmember connecting said two uprights, and a forehead crossmember bridging said two uprights for retaining said two shoulder members and said neck cross member in position on the head and shoulders of the user;

said forhead crossmember being an adjustable strap;

said supporting frame being pivoted to upper ends of said uprights about aligned horizontal axes; and a locking means preventing tilting of said supporting frame beyond a position at approximately right angles to said uprights.

2. Device according to claim 1, wherein each of said shoulder members can pivot freely about the vertical axis of the associated upright.

3. Device according to claim 1, wherein each of said shoulder members can pivot freely about the vertical axis of the associated upright, whereby the device may be folded flat by virtue of the various pivots.

* * * * *